US009801255B2

(12) United States Patent
Radermacher

(10) Patent No.: US 9,801,255 B2
(45) Date of Patent: Oct. 24, 2017

(54) DIMMABLE LIGHTING DEVICE

(75) Inventor: Harald Josef Günther Radermacher, Aachen (DE)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 518 days.

(21) Appl. No.: 13/806,289

(22) PCT Filed: Jun. 10, 2011

(86) PCT No.: PCT/IB2011/052538

§ 371 (c)(1),
(2), (4) Date: Dec. 21, 2012

(87) PCT Pub. No.: WO2012/001561

PCT Pub. Date: Jan. 5, 2012

(65) Prior Publication Data

US 2013/0093323 A1 Apr. 18, 2013

(30) Foreign Application Priority Data

Jun. 30, 2010 (EP) ..... 10167956

(51) Int. Cl.
*H05B 37/02* (2006.01)
*H05B 33/08* (2006.01)

(52) U.S. Cl.
CPC ..... *H05B 37/02* (2013.01); *H05B 33/083* (2013.01); *H05B 33/0872* (2013.01)

(58) Field of Classification Search
USPC ..... 315/71, 113, 185, 309
See application file for complete search history.

(56) References Cited

U.S. PATENT DOCUMENTS 6,411,046 B1 6/2002 Muthu
2005/0243022 A1 11/2005 Negru
(Continued)

FOREIGN PATENT DOCUMENTS

DE 102009022070 A1 11/2010
JP 11162660 A 6/1999
(Continued)

*Primary Examiner* — Douglas W Owens
*Assistant Examiner* — Syed M Kaiser
(74) *Attorney, Agent, or Firm* — Akarsh P. Belagodu

(57) ABSTRACT

The invention relates to lighting devices (100) for producing ultimate light comprising first light of a relatively warm color and second light of a relatively cool color. The lighting devices (100) comprise first and second circuits (1, 2) for producing the first and second light, third circuits (3) for reaching a temperature per intensity state of the ultimate light, and fourth circuits (4) thermally coupled to the third circuits (3) and comprising temperature-dependent circuits for giving the ultimate light a, for example, relatively warm color at lower intensity states and for giving the ultimate light a, for example, relatively cool color at higher intensity states. To this end, the third circuits (3) may comprise resistors (31) and/or diodes (32) and/or zener diodes (33), and the temperature-dependent circuits may comprise negative temperature coefficient resistors (41) connected in parallel to the first circuits (1) or positive temperature coefficient resistors (42) connected in parallel to the second circuits (2). Such a lighting device (100) may provide black body line dimming.

16 Claims, 4 Drawing Sheets

(56) References Cited

U.S. PATENT DOCUMENTS

| | | | | |
|---|---|---|---|---|
| 2008/0106205 | A1 | 5/2008 | Wada et al. | |
| 2010/0134016 | A1* | 6/2010 | York et al. | 315/113 |
| 2010/0134018 | A1 | 6/2010 | Tziony et al. | |
| 2010/0194465 | A1 | 8/2010 | Salih et al. | |
| 2011/0068701 | A1* | 3/2011 | van de Ven et al. | 315/185 R |
| 2011/0089838 | A1* | 4/2011 | Pickard et al. | 315/113 |

FOREIGN PATENT DOCUMENTS

| | | | |
|---|---|---|---|
| JP | 2000260582 | A | 9/2000 |
| JP | 2002009343 | A | 1/2002 |
| JP | 2004192001 | A | 7/2004 |
| JP | 2005310997 | A | 11/2005 |
| JP | 2006261160 | A | 9/2006 |
| JP | 2008262823 | A | 10/2008 |
| WO | 2007035883 | A2 | 3/2007 |
| WO | 2008135927 | A1 | 11/2008 |
| WO | 2008146811 | A1 | 12/2008 |
| WO | 2009048956 | A2 | 4/2009 |
| WO | 2009116854 | A2 | 9/2009 |
| WO | 2010103480 | A2 | 9/2010 |
| WO | 2011037774 | A1 | 3/2011 |
| WO | 2011053708 | A1 | 5/2011 |

* cited by examiner

DIMMABLE LIGHTING DEVICE

FIELD OF THE INVENTION

The invention relates to a lighting device for, in a first state, producing ultimate light having a first intensity and for, in a second state, producing ultimate light having a second intensity higher than the first intensity, said ultimate light comprising first light having a first color temperature and second light having a second color temperature higher than the first color temperature.

The invention further relates to a system comprising a lighting device and to a method.

BACKGROUND OF THE INVENTION

A lighting device for, in a first state, producing ultimate light having a first intensity and for, in a second state, producing ultimate light having a second intensity higher than the first intensity, is of common general knowledge. The first state is a low intensity state (a dimming state), and the second state is a higher intensity state (another dimming state or a non-dimming state). To produce the ultimate light, first light of a first, warm color and second light of a second, cool color are mixed. In that case, said ultimate light comprises first light having a first color temperature and second light having a second color temperature higher than the first color temperature.

SUMMARY OF THE INVENTION

It is an object of the invention to provide an improved lighting device for producing ultimate light. Further objects are to provide a system and a method.

According to a first aspect, a lighting device is provided for, in a first state, producing ultimate light having a first intensity and for, in a second state, producing ultimate light having a second intensity higher than the first intensity, said ultimate light comprising first light having a first color temperature and second light having a second color temperature higher than the first color temperature, the lighting device comprising a first circuit for producing the first light, the first circuit comprising at least one first light emitting diode, a second circuit for producing the second light, the second circuit comprising at least one second light emitting diode, a third circuit for, in the first state, reaching a first temperature and for, in the second state, reaching a second temperature higher than the first temperature, and a fourth circuit thermally coupled to the third circuit, a ratio being equal to the first power supplied to the first circuit divided by the second power supplied to the second circuit, the fourth circuit comprising a temperature-dependent circuit for adapting the ratio such that the ultimate light of the second intensity has a second ultimate color temperature different from a first ultimate color temperature of the ultimate light of the first intensity.

The first circuit produces first light having a first color temperature, and the second circuit produces second light having a second color temperature higher than the first color temperature. The third circuit reaches, in the first state, a first temperature and, in the second state, a second temperature higher than the first temperature. A ratio is defined to be equal to the first power supplied to (consumed by) the first circuit divided by the second power supplied to (consumed by) the second circuit. The fourth circuit is thermally coupled to the third circuit and comprises a temperature-dependent circuit for adapting the ratio such that the ultimate light of the second intensity has a second ultimate color temperature different from a first ultimate color temperature of the ultimate light of the first intensity. As a result, an improved lighting device has been provided for producing ultimate light having a first ultimate color temperature at a lower intensity and having a second ultimate color temperature at a higher intensity, with the first and second ultimate color temperatures being different. This is a great advantage, for example, in environments where the ultimate color temperature should depend on an intensity of the ultimate light.

The lighting device is further advantageous in that it is low-cost. The lighting device is yet further advantageous in that it shows a great freedom of design, owing to the fact that both the third circuit and the fourth circuit as well as the thermal coupling between these circuits each contribute to the freedom of design.

The reason that the light produced by the lighting device is called "ultimate" light is to avoid confusion with the first light having a first color temperature and with the second light having a second color temperature higher than the first color temperature. Said ultimate light comprises this first and second light. Similarly, the reason that the color temperature of the ultimate light is called "ultimate" color temperature is to avoid confusion with the first color temperature and with the second color temperature.

Of course, said ultimate light may show one of three or more different intensities, and/or may comprise three or more different kinds of light of different color temperatures, and/or may have one of three or more different ultimate color temperatures.

An embodiment of the lighting device is defined by the second ultimate color temperature being higher than the first ultimate color temperature. As a result, an improved lighting device has been provided for producing ultimate light having a relatively warm color at a lower intensity and having a relatively cool color at a higher intensity. This is a great advantage, for example, in lighting devices for lighting a home environment/business office etc.

An embodiment of the lighting device is defined by the first, second and third circuits being serially connected and the fourth circuit being connected in parallel to one of the first and second circuits. This embodiment is advantageous in that it offers greater freedom of design. Alternatively, the first and second circuits may for example be connected in parallel, with the fourth circuit for example being connected serially to one of the first and second circuits, but then there will be less freedom of design, owing to the fact that across each one of two branches in a parallel connection the same voltage difference will be present. This limits the free selection of the number of light emitting diodes per branch or requires the addition of another element to one of the branches.

An embodiment of the lighting device is defined by the third circuit comprising a resistor and/or a diode and/or a zener diode, and the temperature-dependent circuit comprising a temperature coefficient resistor. This embodiment is advantageous in that it is extremely low-cost. Alternatively, the temperature-dependent circuit may comprise a converter for converting a temperature of the third circuit into a control signal for controlling switches, such as transistors, each switch being controlled for short-circuiting for example one light emitting diode of a group of light emitting diodes of the first or second circuit, but this will make the lighting device more expensive.

An embodiment of the lighting device is defined by the temperature coefficient resistor being a negative temperature coefficient resistor connected in parallel to the first circuit. At a higher intensity, the third circuit will be warmer, and the negative temperature coefficient resistor or NTC resistor will show a lower resistance. As a result, the first circuit will be by-passed to a higher extent, the first light will show a slightly reduced intensity, and the ultimate light will get a higher ultimate color temperature.

An embodiment of the lighting device is defined by the temperature coefficient resistor being a positive temperature coefficient resistor connected in parallel to the second circuit. At a higher intensity, the third circuit will be warmer, and the positive temperature coefficient resistor or PTC resistor will show a higher resistance. As a result, the second circuit will be by-passed to a lower extent, the second light will show a slightly increased intensity, and the ultimate light will get a higher ultimate color temperature.

An embodiment of the lighting device is defined by the fourth circuit further comprising a resistor and/or a diode and/or a zener diode connected to the temperature coefficient resistor. This embodiment is advantageous in that it offers greater freedom of design against slightly higher costs.

An embodiment of the lighting device is defined by the first and second ultimate color temperatures being located on or relatively close to a black body line of a chromaticity space. This is also known as black body line dimming.

An embodiment of the lighting device is defined by the first color temperature corresponding to warm white or red or yellow or a color relatively similar thereto, and the second color temperature corresponding to cold white or blue or green or a color relatively similar thereto. Red and yellow have relatively low color temperatures and are relatively warm colors, and blue and green have relatively high color temperatures and are relatively cool colors.

An embodiment of the lighting device is defined by further comprising a fifth circuit thermally coupled to a heat sink of one or more of the first and second circuits, the fifth circuit comprising a further temperature-dependent circuit for stabilizing the ultimate light.

Owing to the fact that a heat sink has a relatively slow thermal response, the heat sink is not well suited for controlling different ultimate color temperatures for different intensities in a dimming environment, but it is very well suited for stabilization purposes.

An embodiment of the lighting device is defined by the further temperature-dependent circuit comprising a temperature coefficient resistor. This embodiment is advantageous in that it is extremely low-cost.

An embodiment of the lighting device is defined by the temperature coefficient resistor being a positive temperature coefficient resistor connected in parallel to the first circuit and/or in parallel to the second circuit. At slowly rising heat sink temperatures, the first circuit and/or the second circuit will get a slowly increasing current. This way, in the case that the intensity of the first and/or second light, without compensation, slowly decreases at slowly rising heat sink temperatures, the ultimate light is stabilized.

According to a second aspect, a system is provided comprising the lighting device according to claim 1 and further comprising a driver for driving the lighting device.

The driver for example provides a current signal to the lighting device, which current signal for example has a first, lower root mean square value and/or a first, smaller amplitude in the first state (the lower intensity state), and for example a second, higher root mean square value and/or a second, larger amplitude in the second state (the higher intensity state). Alternatively, the driver may provide a voltage signal to the lighting device, which voltage signal results in such a current signal, etc.

An embodiment of the system is defined by the driver comprising a variable amplitude Direct Current driver or a Pulse Width Modulation dimming Direct Current driver or a rectified Alternating Current driver.

An important feature of the system is that the way in which the driver accomplishes the provision of different drive signals, does not influence the provision of the ultimate light.

According to a third aspect, a method is provided for, in a first state, producing ultimate light having a first intensity and for, in a second state, producing ultimate light having a second intensity higher than the first intensity, said ultimate light comprising first light having a first color temperature and second light having a second color temperature higher than the first color temperature, the method comprising via a first circuit, producing the first light, the first circuit comprising at least one first light emitting diode, via a second circuit, producing the second light, the second circuit comprising at least one second light emitting diode, via a third circuit, in the first state, reaching a first temperature and, in the second state, reaching a second temperature higher than the first temperature, and via a fourth circuit thermally coupled to the third circuit, a ratio being equal to the first power supplied to the first circuit divided by the second power supplied to the second circuit, the fourth circuit comprising a temperature-dependent circuit, adapting the ratio such that the ultimate light of the second intensity has a second ultimate color temperature different from a first ultimate color temperature of the ultimate light of the first intensity.

An insight could be that ultimate light should not necessarily have the same ultimate color temperature for different intensities.

A basic idea could be that a third circuit is to be used for providing an intensity indication via a temperature indication and that a fourth circuit thermally coupled to the third circuit is to be used for giving the ultimate light of a higher intensity a different ultimate color temperature than the ultimate light of a lower intensity.

The problem of providing an improved lighting device for producing ultimate light has been solved. An improvement lies in the fact that this ultimate light will have a first ultimate color temperature at a lower intensity and will have a second ultimate color temperature at a higher intensity, with the first and second ultimate color temperatures being different.

A further advantage could be that the lighting device is low-cost and shows a great freedom of design.

These and other aspects of the invention will be apparent from and elucidated with reference to the embodiments described hereinafter.

DETAILED DESCRIPTION OF EMBODIMENTS

Figure 1:
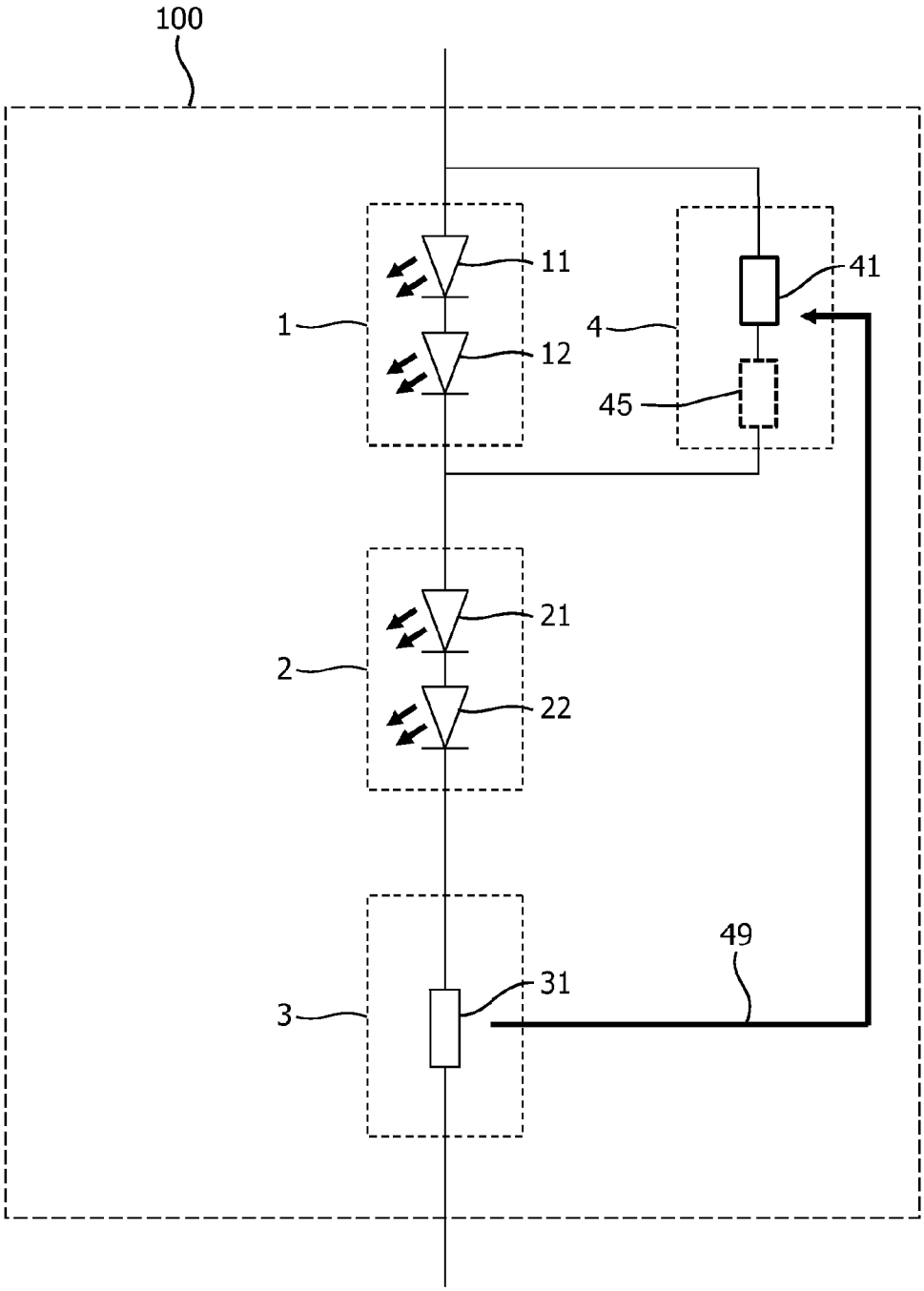
FIG. 1 shows a first embodiment of a lighting device.

In FIG. 1, a first embodiment of a lighting device 100 is shown. The lighting device 100 comprises a first circuit 1 for producing first light having a first color temperature. The first circuit 1 comprises two first light emitting diodes 11 and 12; alternatively it may comprise only one first light emitting diode or three or more first light emitting diodes in whatever connection. The lighting device 100 further comprises a second circuit 2 for producing second light having a second color temperature higher than the first color temperature. The second circuit 2 comprises two second light emitting diodes 21 and 22; alternatively it may comprise only one second light emitting diode or three or more second light emitting diodes in whatever connection. This first embodiment is designed to receive a direct current supply signal or DC supply signal.

The lighting device 100 produces, in a first state, ultimate light having a first intensity and produces, in a second state, ultimate light having a second intensity higher than the first intensity. This ultimate light comprises the first light having the first color temperature and the second light having the second color temperature. The first color temperature for example corresponds to warm white or red or yellow or a color relatively similar thereto. The second color temperature for example corresponds to cold white or blue or green or a color relatively similar thereto. The first (second) circuit 1 (2) may comprise different light emitting diodes (11, 12, 21, 22) that produce light of different colors that together result in the first (second) light of the first (second) color. Via a selection of the several colors within each circuit, the resulting color and a resulting color temperature per circuit can be set.

The lighting device 100 further comprises a third circuit 3 that, in the first state, reaches a first temperature and that, in the second state, reaches a second temperature higher than the first temperature. The lighting device 100 yet further comprises a fourth circuit 4 thermally coupled to the third circuit 3; in other words there is a thermal coupling 49 between the third circuit 3 and the fourth circuit 4. A ratio is defined to be equal to the first power supplied to or consumed by the first circuit 1 divided by the second power supplied to or consumed by the second circuit 2. Alternatively, another ratio may be defined to be equal to a first current flowing through the first circuit 1 divided by a second current flowing through the second circuit 2. The fourth circuit 4 comprises a temperature-dependent circuit for adapting the ratio such that the ultimate light of the second intensity has a, for example, lower or higher ultimate color temperature than the ultimate light of the first intensity.

In FIG. 1, the first, second and third circuits 1, 2 and 3 are serially connected and the fourth circuit 4 is connected in parallel to the first circuit 1. The third circuit 3 comprises a resistor 31, and the temperature-dependent circuit comprises a negative temperature coefficient resistor 41.

At a higher intensity (i.e. more power supplied to the first and second circuits 1 and 2, resulting in a larger current flowing through the first and second circuits 1 and 2), the third circuit 3 will be warmer, and the negative temperature coefficient resistor 41 or NTC resistor 41 will show a lower resistance. As a result, the first circuit 1 will be by-passed to a higher extent, the first light will show a slightly reduced intensity, and the ultimate light will have a higher ultimate color temperature owing to the fact that the second light will contribute more to the ultimate light than before.

Figure 2:
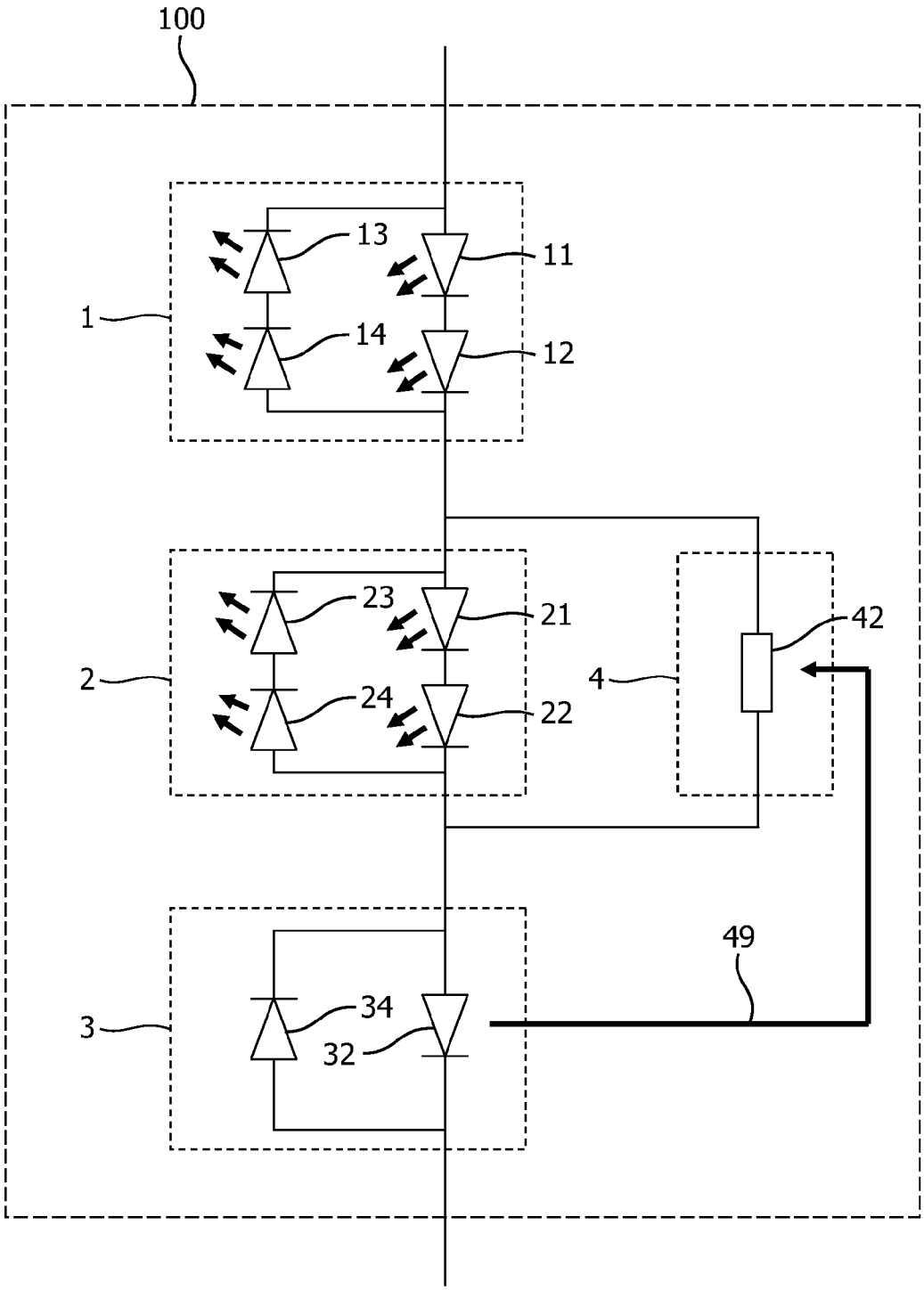
FIG. 2 shows a second embodiment of a lighting device.

In FIG. 2, a second embodiment of a lighting device 100 is shown. This lighting device 100 differs from the one shown in the FIG. 1 in that the second embodiment is designed to receive an alternating current supply signal or AC supply signal. For this reason, the first and second circuits 1 and 2 each have a bi-directional structure. The first circuit 1 comprises first and second anti-parallel branches. The first branch comprises two serially connected first light emitting diodes 11 and 12. The second branch comprises two serially connected first light emitting diodes 13 and 14. The second circuit 2 comprises third and fourth anti-parallel branches. The third branch comprises two serially connected second light emitting diodes 21 and 22. The fourth branch comprises two serially connected second light emitting diodes 23 and 24. This lighting device 100 further differs from the one shown in the FIG. 1 in that the fourth circuit 4 is connected in parallel to the second circuit 2, and in that the third circuit 3 comprises two anti-parallel diodes 32 and 34 in a bi-directional structure, and in that the temperature-dependent circuit comprises a positive temperature coefficient resistor 42. As a result, no matter what the direction of a current flow through the lighting device 100 will be, either one of each pair of anti-parallel branches will be ready to emit light.

Preferably, both anti-parallel diodes 32 and 34 should be in thermal communication with the fourth circuit 4. This can be achieved for example by placing the fourth circuit 4 between two portions of the third circuit 3. Each branch may alternatively comprise only one or three or more light emitting diodes in whatever connection, and more branches per circuit are not to be excluded.

At a higher intensity (i.e. more power is supplied to the first and second circuits 1 and 2, resulting in a larger current flowing through the first and second circuits 1 and 2), the third circuit 3 will be warmer, and the positive temperature coefficient resistor 42 or PTC resistor 42 will show a higher resistance. As a result, the second circuit 2 will be by-passed to a lesser extent, the second light will show a slightly increased intensity, and the ultimate light will have a higher ultimate color temperature owing to the fact that the second light will contribute more to the ultimate light than before.

This way, with respect to FIGS. 1 and 2, the ultimate color temperatures of the ultimate light of the first and second intensities may be located on or relatively close to a black body line of a chromaticity space (black body line dimming).

Figure 3:
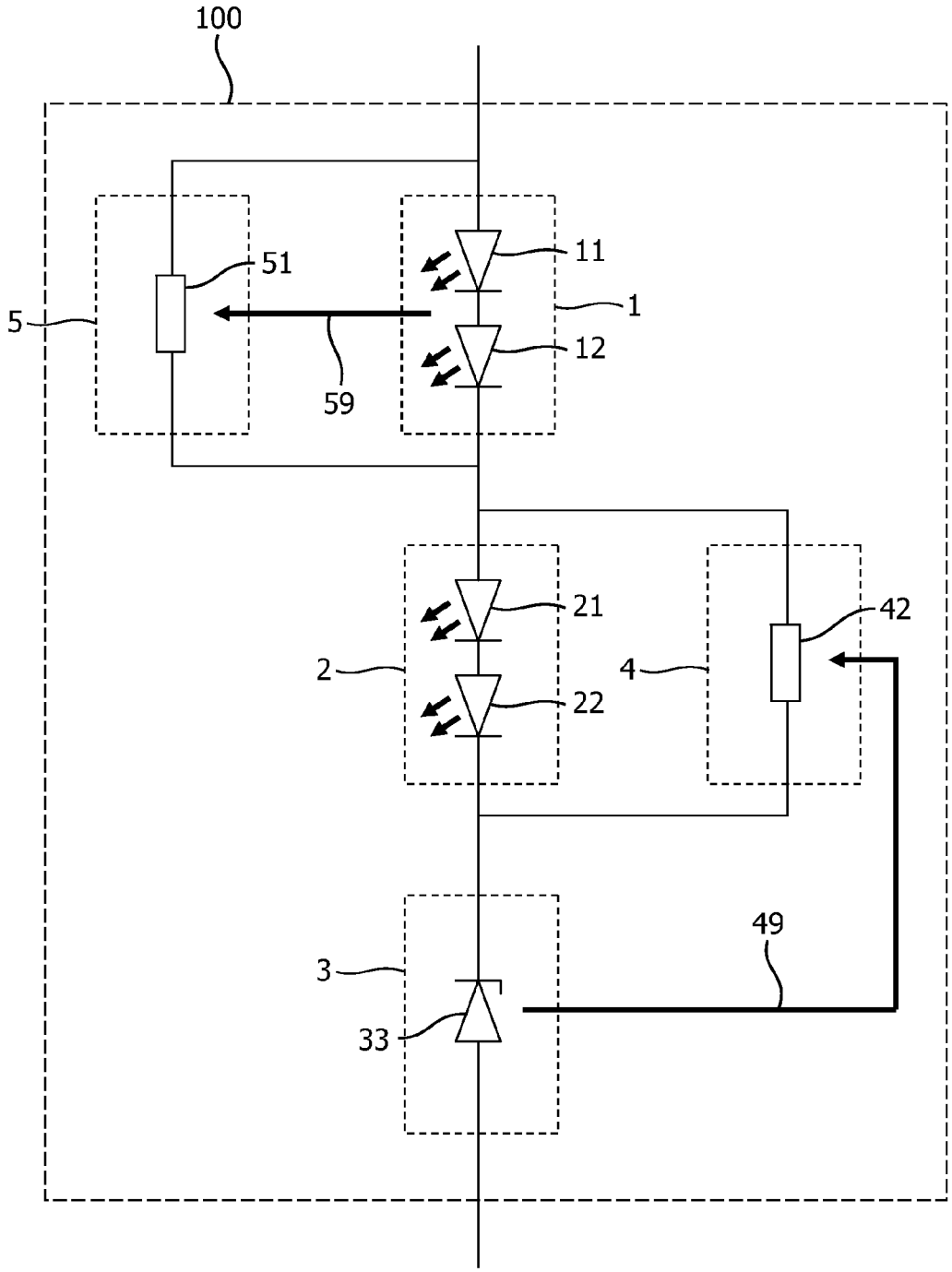
FIG. 3 shows a third embodiment of a lighting device.

In FIG. 3, a third embodiment of a lighting device 100 is shown. This lighting device 100 only differs from the one shown in the FIG. 1 in that the fourth circuit 4 is connected in parallel to the second circuit 2, and in that the temperature-dependent circuit comprises a positive temperature coefficient resistor 42, and in that the third circuit 3 comprises a zener diode 33, and in that the lighting device 100 further comprises a fifth circuit 5 connected in parallel to the first circuit 1.

The fifth circuit 5 is thermally coupled to a heat sink of the first circuit 1, in other words there is a thermal coupling 59 between the heat sink of first circuit 1 and the fifth circuit 5. Alternatively, the fifth circuit 5 may be thermally coupled to a heat sink of the second circuit 2 or to both heat sinks or to a mutual heat sink of the first and second circuits 1 and 2. An example of such a heat sink is shown as element 65 in FIG. 5. The fifth circuit 5 comprises a further temperature-dependent circuit for stabilizing the ultimate light. This further temperature-dependent circuit for example comprises a temperature coefficient resistor, in this case a positive temperature coefficient resistor 51.

At slowly rising heat sink temperatures, the first circuit 1 will get a slowly increasing current. This way, in the case that the intensity of the first light, without compensation, slowly decreases at slowly rising heat sink temperatures, the ultimate light is stabilized. Alternatively and/or in addition, the temperature coefficient resistor may be a positive temperature coefficient resistor connected in parallel to the second circuit 2. At slowly rising heat sink temperatures, the second circuit 2 will get a slowly increasing current. This way, in the case that the intensity of the second light, without compensation, slowly decreases at slowly rising heat sink temperatures, the ultimate light is stabilized. Alternatively, each further temperature-dependent circuit may comprise another temperature coefficient resistor, for example in the case that the light emitting diodes require another temperature stabilization and/or another temperature compensation.

Figure 4:
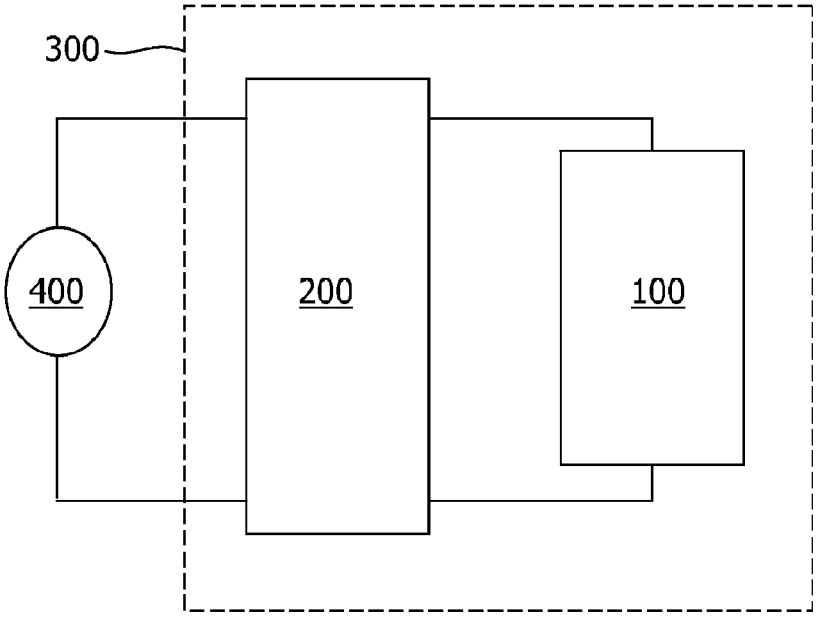
FIG. 4 shows a system comprising a lighting device.

In FIG. 4, a system 300 is shown comprising a lighting device 100 and further comprising a driver 200 for driving the lighting device 100. The driver 200 may be coupled to a source 400. The driver 200 may for example comprise a variable amplitude Direct Current driver or a Pulse Width Modulation dimming Direct Current driver or a rectified Alternating Current driver.

Figure 5:
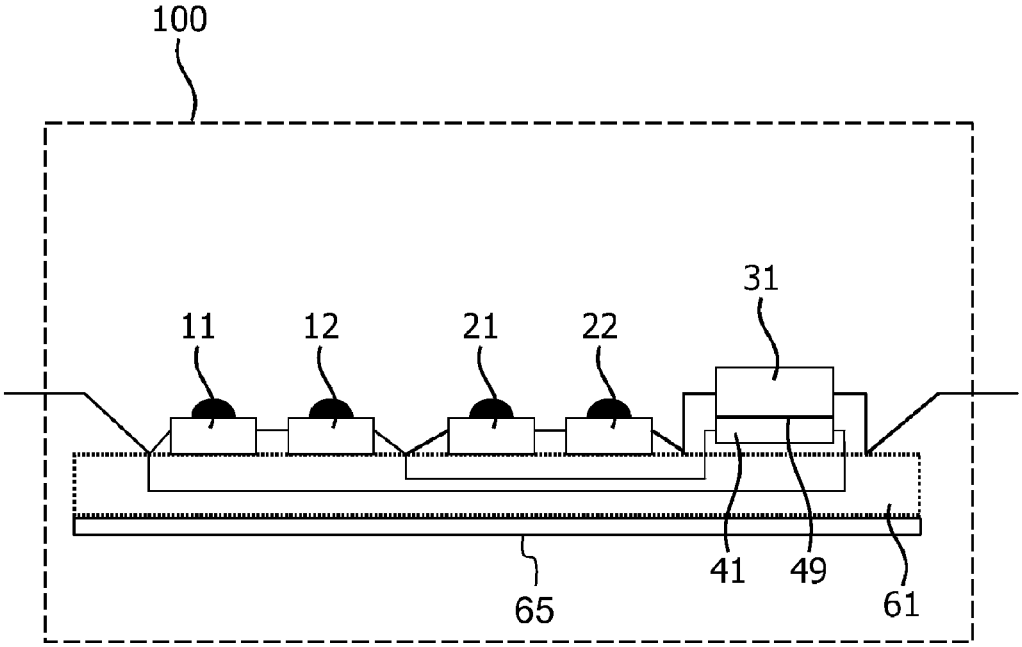
FIG. 5 shows a sketch of a realization of the first embodiment.

In FIG. 5, a sketch of a realization of the first embodiment is shown. The lighting device 100 comprises light emitting diodes 11, 12, 21 and 22 that are mounted on a carrier 61. This carrier 61 serves for electrical connection, for mechanically supporting the components and for cooling the light emitting diodes 11, 12, 21 and 22, by providing a thermal coupling to heat sink 65. As shown in FIG. 1, the first, second and third circuits 1-3 are connected serially. The negative temperature coefficient resistor 41 of the fourth circuit 4 is in close contact with the resistor 31 of the third circuit 3, such that there is a thermal coupling 49 between the third circuit 3 and the fourth circuit 4. It is interesting to note that both the third circuit 3 and the fourth circuit 4, while being in close contact and hence in thermal communication with each other, are preferably not in close contact with the carrier 61 or other components. As a result, the temperature of the third circuit 3 is determined to a large extent by the current flowing through this third circuit 3 and the resulting voltage drop and the power dissipation that depend on its electrical properties (i.e. whether the circuit is a resistor, a diode etc.). The temperature, and hence the resistance, of the fourth circuit 4 is in turn influenced by the temperature of the third circuit 3, resulting in a desired functionality that the current/power supplied to the first circuit 1, and hence the ratio as defined before, is controlled by the signal/power/root mean square current/energy etc. that the lighting device 100 receives from its driver. If the components of the third and fourth circuits 3 and 4 are relatively small and relatively isolated from the carrier 61, they will respond relatively fast to changes in the received signal/power/root mean square current/energy etc. Further components (like cables, sensors, optical elements such as lenses or reflectors) may be present that are not shown here.

Alternatively, in view of FIGS. 1 to 3, the first and second circuits 1 and 2 may for example be connected in parallel, with the fourth circuit 4 for example being connected serially to one of the first and second circuits 1 and 2, but then there will be less freedom of design owing to the fact that across each one of two branches in a parallel connection the same voltage difference will be present. This limits the free selection of the number of light emitting diodes per branch or requires the addition of another element to one of the branches.

Alternatively, the temperature-dependent circuit in the fourth circuit 4 may comprise a converter for converting a temperature of the third circuit 3 into a control signal for controlling switches such as transistors, each switch being controlled for short-circuiting for example one light emitting diode of a group of light emitting diodes 11-12 (21-22) of the first (second) circuit 1 (2), but this will make the lighting device 100 more expensive.

In addition, the fourth circuit 4 may for example be provided with an element 45, which may include a resistor and/or a diode and/or a zener diode, connected to the temperature coefficient resistor 41, 42 to further increase the freedom of design. In general, a parallel connection of an element and a NTC (PTC) resistor may be replaced by a serial connection of this element and a PTC (NTC) resistor, and vice versa. The third circuit 3 may comprise two or more of: a group of resistors, diodes and zener diodes. Any embodiment shown in any of the FIGS. 1-3 and any part thereof may be combined with any embodiment shown in any other of the FIGS. 1-3 and any part thereof.

Each (group of) light emitting diode(s) may comprise an inorganic light emitting diode or an organic light emitting diode, and may comprise a low voltage light emitting diode or a high voltage light emitting diode, and may comprise a DC light emitting diode or an AC light emitting diode.

Summarizing, the invention relates to lighting devices 100 for producing ultimate light comprising first light of a relatively warm color and second light of a relatively cool color. The lighting devices 100 comprise first and second circuits 1, 2 for producing the first and second light, third circuits 3 for reaching a temperature per intensity state of the ultimate light, and fourth circuits 4 thermally coupled to the third circuits 3 and comprising temperature-dependent circuits for giving the ultimate light a, for example, relatively warm color at lower intensity states and for giving the ultimate light a, for example, relatively cool color at higher intensity states. For this purpose, the third circuits 3 may comprise resistors 31 and/or diodes 32 and/or zener diodes 33, and the temperature-dependent circuits may comprise negative temperature coefficient resistors 41 connected in parallel to the first circuits 1 or positive temperature resistors 42 connected in parallel to the second circuits 2. Such a lighting device 100 may provide black body line dimming.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope.

The invention claimed is:

1. A lighting device for, in a first state, producing ultimate light having a first intensity and for, in a second state, producing ultimate light having a second intensity higher than the first intensity, said ultimate light comprising first light having a first color temperature and second light having a second color temperature higher than the first color temperature, the lighting device comprising a first circuit for producing the first light, the first circuit comprising at least one first light emitting diode, a second circuit for producing the second light, the second circuit comprising at least one second light emitting diode, a third circuit for, in the first state, reaching a first temperature and for, in the second state, reaching a second temperature higher than the first temperature, and a fourth circuit thermally coupled to the third circuit, the fourth circuit comprising a temperature-dependent circuit for adapting a ratio of a first power supplied to the first circuit divided by a second power supplied to the second circuit such that the ultimate light of the second intensity has a second ultimate color temperature different from a first ultimate color temperature of the ultimate light of the first intensity.

2. The lighting device according to claim 1, the second ultimate color temperature being higher than the first ultimate color temperature.

3. The lighting device according to claim 2, the first, second and third circuits being serially connected and the fourth circuit being connected in parallel to one of the first and second circuits.

4. The lighting device according to claim 3, the third circuit comprising a resistor and/or a diode and/or a zener diode, and the temperature-dependent circuit comprising a temperature coefficient resistor.

5. The lighting device according to claim 4, the temperature coefficient resistor being a negative temperature coefficient resistor connected in parallel to the first circuit.

6. The lighting device according to claim 4, the temperature coefficient resistor being a positive temperature coefficient resistor connected in parallel to the second circuit.

7. The lighting device according to claim 4, the fourth circuit further comprising an element connected to the temperature coefficient resistor, wherein the element comprises at least one of a resistor, a diode, and a Zener diode.

8. The lighting device according to claim 1, the first and second ultimate color temperatures being located on a black body line of a chromaticity space.

9. The lighting device according to claim 1, the first color temperature corresponding to warm white or red or yellow or a color relatively similar thereto, and the second color temperature corresponding to cold white or blue or green or a color relatively similar thereto.

10. The lighting device according to claim 1, further comprising:

a fifth circuit comprising a further temperature-dependent circuit for stabilizing the ultimate light; and a heat sink thermally coupled to the fifth circuit and at least one of the first and second circuits.

11. The lighting device according to claim 10, the further temperature-dependent circuit comprising a temperature coefficient resistor.

12. The lighting device according to claim 11, the temperature coefficient resistor being a positive temperature coefficient resistor connected in parallel to the first circuit and/or in parallel to the second circuit.

13. A system comprising the lighting device according to claim 1 and further comprising a driver for driving the lighting device.

14. The system according to claim 13, the driver comprising a variable amplitude Direct Current driver or a Pulse Width Modulation dimming Direct Current driver or a rectified Alternating Current driver.

15. A method for, in a first state, producing ultimate light having a first intensity and for, in a second state, producing ultimate light having a second intensity higher than the first intensity, said ultimate light comprising first light having a first color temperature and second light having a second color temperature higher than the first color temperature, the method comprising via a first circuit, producing the first light, the first circuit comprising at least one first light emitting diode, via a second circuit, producing the second light, the second circuit comprising at least one second light emitting diode, via a third circuit, in the first state, reaching a first temperature and, in the second state, reaching a second temperature higher than the first temperature, and via a fourth circuit thermally coupled to the third circuit, the fourth circuit comprising a temperature-dependent circuit, adapting a ratio of a first power supplied to the first circuit divided by a second power supplied to the second circuit such that the ultimate light of the second intensity has a second ultimate color temperature different from a first ultimate color temperature of the ultimate light of the first intensity.

16. The method of claim 15, further comprising:

via a temperature-dependent fifth circuit, stabilizing the ultimate light; and coupling the fifth circuit and at least one of the first and second circuits to a common heat sink.

* * * * *